US005326291A

United States Patent [19]

Moody

[11] Patent Number: 5,326,291

[45] Date of Patent: Jul. 5, 1994

[54] ACTUATOR MECHANISM FOR OPERATING A TORPEDO TUBE SHUTTER DOOR

[75] Inventor: Paul E. Moody, Barrington, R.I.

[73] Assignee: The United States of America as represented by the Secretary of the Navy, Washington, D.C.

[21] Appl. No.: 959,596

[22] Filed: Oct. 13, 1992

[51] Int. Cl.[5] ..... B63H 5/12

[52] U.S. Cl. ..... 440/61; 92/68

[58] Field of Search ..... 92/62, 65, 68, 76, 61, 92/66, 72; 91/177, 176, 216 B, 520, 509; 114/312, 342, 201 R, 202; 440/61; 49/248, 340, 394; 105/283, 286

[56] References Cited

U.S. PATENT DOCUMENTS 3,633,617 1/1972 Stacey ..... 91/520
4,526,085 7/1985 Morizur ..... 91/520
4,622,886 11/1986 Imada ..... 91/520
4,709,618 12/1987 Zongker ..... 91/520

*Primary Examiner*—Robert J. Oberleitner
*Assistant Examiner*—Clifford T. Bartz
*Attorney, Agent, or Firm*—Michael J. McGowan; Prithvi C. Lall; Michael F. Oglo

[57] ABSTRACT

An actuator mechanism for operating the shutter door of a torpedo tube includes two hydraulic cylinders connected in series and a plurality of interconnected links pivotally connected between the inner hull and the shutter door. In operation, the combined movement of the hydraulic cylinders rotates an elongated torque arm and a transfer link about a rotatable shaft. As the transfer link rotates it moves the end of the link inwardly away from the outer hull. As the transfer link further rotates away from the outer hull, it draws the connector link and the shutter door inwardly. The added throw of the two cylinders cooperate with the longer torque arm to provide an increased moment, and hence greater opening force on the shutter door.

3 Claims, 2 Drawing Sheets

ACTUATOR MECHANISM FOR OPERATING A TORPEDO TUBE SHUTTER DOOR

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The instant invention relates to submersible vessels and more particularly to an actuator mechanism for operating a torpedo tube shutter door.

(2) Description of the Prior Art

Referring to the drawing FIGS. 1 and 2, the prior art actuator mechanism for operating a hinged torpedo tube shutter door 10 is illustrated and it is generally indicated at 12. It is noted that FIG. 1 shows the mechanism 12 in the closed position and that FIG. 2 shows the mechanism 12 in the open position. The torpedo tube shutter door 10 is a long rectangular shaped fairing plate which streamlines the outer hull 14 of a submarine when the submarine's torpedo tube outer door is closed. The shutter door 10 is necessary to prevent flow turbulence in the flow field of the submarine as it propels itself through the water. Prior to firing a torpedo, the shutter door 10 is opened to provide a clear path for the torpedo to be ejected from within the ship. It is noted that the shutter door 10 is not a pressure containing door as this function is accomplished by a much stronger pressure sealed torpedo tube muzzle door. In addition, there is no pressure seal between the shutter door 10 and the outer hull 14. Therefore, there are no forces on the shutter door 10 which are attributable to sea pressure. However, the shutter door 10 is subjected to hydrodynamic flow over its surface. Since the firing line 16 of an ejected torpedo typically intersects the outer hull 14 at an angle anywhere from 12° to 14.5°, the shutter door 10 may be quite long, and therefore the hydrodynamic forces exerted thereon can be quite significant. For example, if the flow velocities across a shutter door produce a 10 psi pressure differential, then a 30 sq. ft. shutter door (4320 sq. in.) would have to overcome a 43,200 pound force plus the shutter's own weight and any system binding forces before it could be operated. While the shutter door is not a pressure containing member, it is designed to be relatively stiff via the use of stiffening members to prevent shutter vibration and deflection and therefore a shutter door may weigh between 1500 and 1800 pounds.

In the existing prior art assembly as illustrated in FIGS. 1 and 2, the power to operate the mechanism 12 comes from a hydraulic cylinder 17 through a power transmission link 18 which provides force to overcome the system moments and weights, forces due to misalignment and binding parts, and the hydrodynamic loads on the shutter door 10 due to the ship's forward motion through the water. Although the system moments and weights can be accurately calculated prior to the actual manufacture of the hardware, the forces due to misalignment and binding of the parts are difficult to calculate due to the varying deflection of parts with varying ship's depths and manufacturing tolerances. The quantification of hydrodynamic loads is equally as difficult to calculate because the hydrodynamic flow, pressure points, and flow vortices vary with different ship's speeds and maneuvers, and varying positions of the shutter door 10 between the fully open and fully closed positions. Unfortunately, the only accurate method to determine these forces is to conduct a full scale ship's test. However, not even a ship's test is 100% accurate due to the variations in construction between like ships in a class. Even if these variation were ignored, such a test would be extremely expensive and could only be conducted after it was too late to incorporate the results into the ship's basic design.

The prior art shutter mechanism 12 is pivotably connected between the inner hull 20 and the shutter door 10 via a series of interconnected links which draw the shutter door inwardly when force is applied through the hydraulic cylinder link 18. In operation of the mechanism 12, the hydraulic cylinder link 18 exerts force to the right as viewed in the drawings figures. The hydraulic cylinder link 18 is pivotably connected to links 22 and 24, and link 22 is pivotally connected to the inner hull 20 at pivot point 26. Movement of hydraulic cylinder link 18 to the right pivots link 22 counterclockwise about point 26 and forces link 24 to the right. Link 24 is pivotably connected to a torque arm 28. The torque arm 28 and a transfer link 30 are keyed to a common shaft 32 which rotates about pivot point 34. Therefore, when link 24 moves to the right, it pivots both links 28 and 30 counterclockwise about pivot point 34. Link 30 is pivotably connected to a connector link 36 at pivot point 38, and link 36 is in turn pivotably connected to the shutter door 10 at pivot point 40. As link 30 rotates in a counterclockwise direction, it moves the end of the link, i.e. pivot point 38, inwardly away from the outer hull 14. As link 30 further rotates away from the outer hull 14, it draws link 36 and the shutter door 10 inwardly. The shutter door 10 is pivotably connected to the outer hull 14 at pivot point 42, and is thus free to move inward as it rotates about pivot point 42. It is necessary to utilize this complex linkage system to prevent the shutter door 10 from inadvertently opening inward due to wave slap. It is pointed out that in the fully closed position, pivot point 38 is located slightly to the left of a straight line drawn between pivot point 34 and pivot point 40. This arrangement permits force from wave slap to be transmitted via the linkage to hydraulic cylinder link 18 which has a positive stop, thus preventing it from moving in the direction of the force. Therefore, it can be seen that the shutter door 10 will not open due to wave slap.

Because of the difficulty in accurately calculating all the potential forces which are exerted on the shutter door, it has been found that the power generated by the prior art mechanism is often insufficient to operate the shutter door under all operating conditions. This flaw in the prior art mechanism can cause significant problems because the inability to operate the shutter door prevents a submarine from being able to fire its torpedoes.

Several solutions to the problem have previously been suggested. The most obvious method to eliminate the torque problems of operating a shutter door would be to replace the hinged shutter doors with rotating shutters. However, this solution is plagued by several problems which relate to the large physical size of rotating shutters. The larger size of a rotating shutter would require extensive modifications of the forward portions of the ship in order to fit the rotary shutter in place. Such extensive ship modifications, whether in a new ship or an existing ship, are cost prohibitive. In addition, there are also problems associated with misalignment of the shutter and deflection of parts.

Another possible solution is to utilize a larger and more powerful hydraulic cylinder 17 to operate link 18. If a larger, more powerful hydraulic cylinder 17 was backfit into an existing design, the larger cylinder 17 would most likely have a larger shaft size. The added power and increased shaft size would require that all the components interconnected with the hydraulic cylinder 17 be strengthened in a like manner. Such a design would also most likely require new support bearings, a new hull stuffing box, and replacement of all the interlock mechanisms, pins, and hinges which transmit or have force applied to them. As a result such a design would be very costly to implement. If the larger hydraulic cylinder 17 were integrated into a new ship construction, it is quite likely that the larger stronger components would not fit in the same space available and thus the forward portions of the ship would also have to be redesigned.

Still another possible solution is to lengthen the travel of the hydraulic power cylinder 17 to facilitate a better mechanical advantage to the shutter door linkage. This type of design is also plagued by a multitude of problems. If the longer hydraulic cylinder were backfit into an existing ship, the increased travel distance would require the shaft bearing supports to be spaced further apart. In addition, the interlock system, support brackets, links, and hinge pivot points would have to be relocated to be compatible with the modified cylinder travel. If it were possible to fit these modified parts into the existing space available, then cost, shock, and timing requirements would have to be addressed. This design would also likely require the use of a larger hydraulic cylinder to withstand shock loads. In addition, the increased travel distance would also cause a longer actuation time due to increased travel length. This could be a critical factor in situations where it is desired to quickly fire weapons in an emergency.

Yet another potential solution for correcting the problem in an existing ship would be to redesign some components to minimize assembly binding and to control pressure differentials caused by hydrodynamic flow. The problem with this solution is that it is impossible to ensure complete system alignment at all depths of operation and to ensure maintenance of system alignment as components wear. In addition, once a ship system is designed, it is difficult to significantly alter the forces resulting from hydrodynamic flow.

In spite of the previously noted alternatives, it is still possible that the shutter doors would not operate under all conditions. Such a failure could result because it is impossible to determine with 100% accuracy all the forces which will be exerted on an operational shutter door.

SUMMARY OF THE INVENTION

The instant invention provides an improved actuator mechanism for operating a torpedo tube shutter door.

Briefly, the actuator mechanism comprises two hydraulic cylinders connected in series and a plurality of interconnected transfer links. A first hydraulic cylinder is mounted at one end to the inner hull. A pivot link is pivotably connected to the inner hull or other fixed submarine structure at one end and the other end thereof is pivotably connected to a hydraulic cylinder link which is coupled to the first hydraulic cylinder. A second hydraulic cylinder is pivotably connected to the second end of the pivot link. A shaft is rotatably mounted to the inner hull and a torque arm is keyed to the rotatable shaft at one end thereof and the other end thereof is pivotably connected to the second end of the second hydraulic cylinder. A transfer link is also keyed to the rotatable shaft and is pivotably connected to a connector link at one end thereof. The other end of the connector link is pivotably connected to the shutter door and the shutter door is pivotably connected to the outer hull.

The improved actuator mechanism reflects a system similar to the prior art system illustrated in FIGS. 1 and 2 except that link 24 is replaced with the second hydraulic cylinder and torque arm 28 is replaced with an elongated torque arm. The improved actuator mechanism 50 operates in a similar manner to the prior art mechanism described in the Background section of this specification, except that when it is desired to open the shutter door 10, hydraulic pressure extends the length of the second hydraulic cylinder which replaces link 24. The extension of the second hydraulic cylinder does not transmit any more force through the linkage system than in the prior art assembly, however the extra throw of the second hydraulic cylinder combined with the normal throw transmitted by the first hydraulic cylinder link results in the ability to replace torque arm 28 with an elongated torque arm. As a result, the elongated torque arm transmits a much higher torque to the transfer link 30. Since the length of transfer link remains unchanged, a greater force is applied at the free end of the link. This greater force is transmitted through connector link to the shutter door 10. The improved design uses the same amount of space as the prior art design and therefore can easily be incorporated into existing ship. In addition, the improved design can be integrated into a new ship without redesigning any of the forward portions of the ship.

Accordingly, it is an object of the instant invention to provide an improved actuator mechanism for operating a torpedo tube shutter door.

It is another object to provide an improved actuator mechanism which is effective and durable in use and which is economically feasible to install.

It is still another object to provide an improved actuator mechanism which can be back-fitted into submarines employing the prior art shutter mechanism as illustrated in FIGS. 1 and 2.

It is yet another object to provide a simple method for multiplying the force to operate a torpedo tube shutter door without redesigning the entire shutter operating mechanism.

BRIEF DESCRIPTION OF THE DRAWINGS

A more complete understanding of the invention and many of the attendant advantages thereto will be readily appreciated as the same become better understood by reference to the following detailed description when considered in conjunction with the accompanying drawings wherein.

DESCRIPTION OF THE PREFERRED EMBODIMENTS

Figure 3:
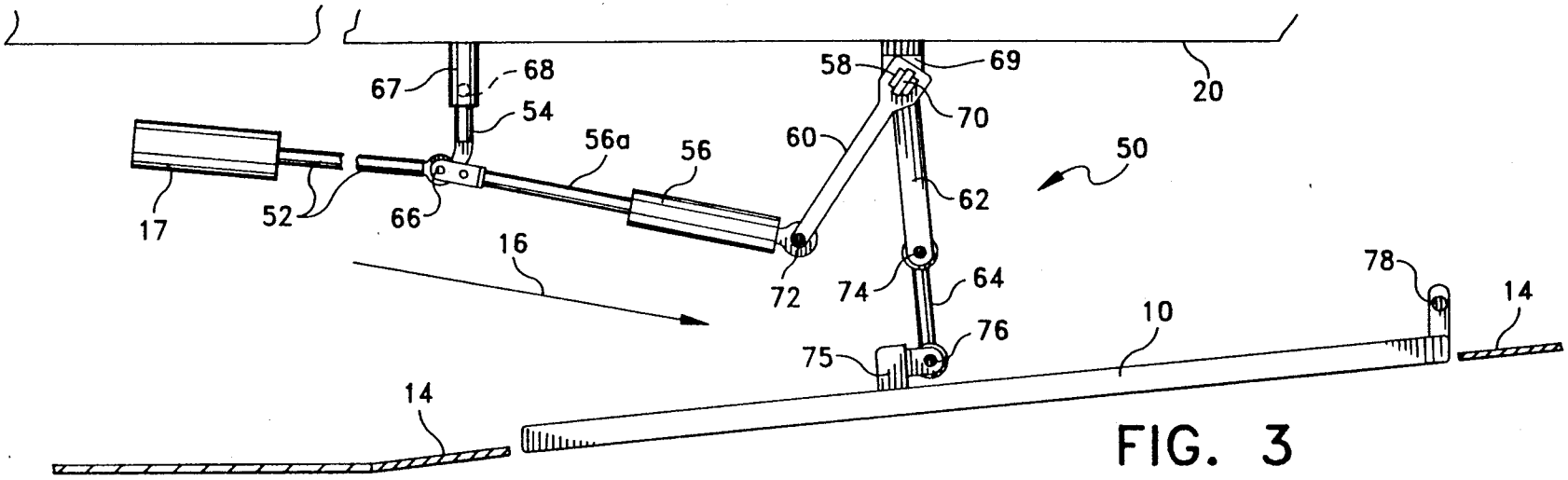
FIG. 3 is an elevational view of the actuator mechanism as embodied in the instant invention with the shutter door in the closed position.
Figure 4:
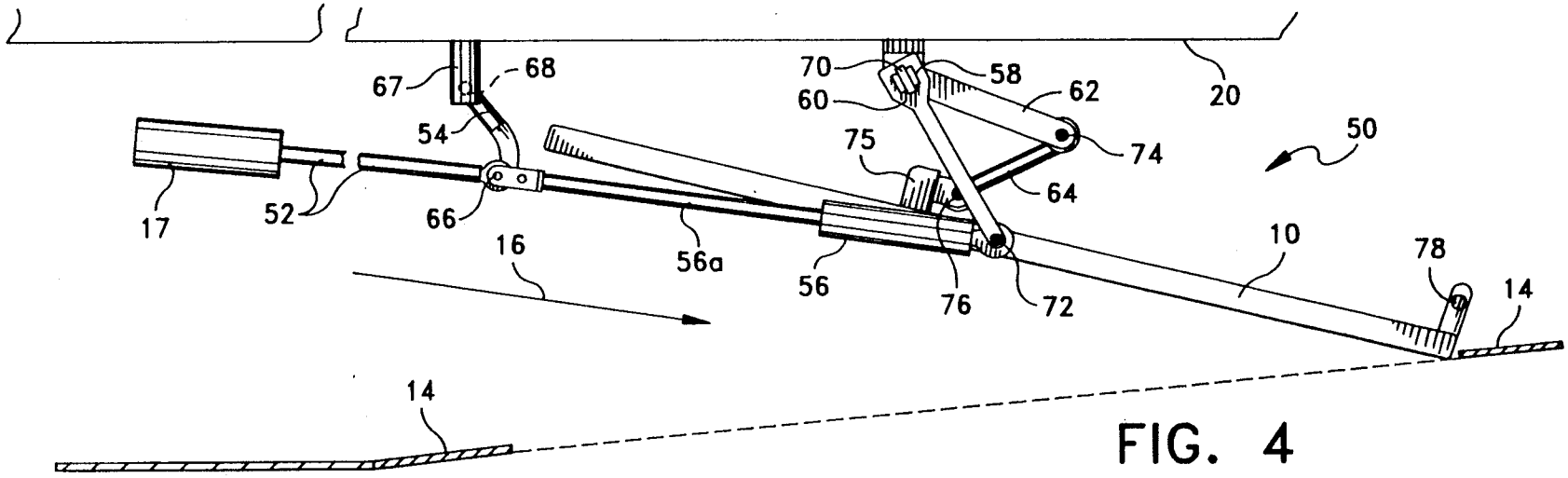
FIG. 4 is a similar view thereof with the shutter door in the open position.

Referring now to drawing FIGS. 3 and 4, the actuator mechanism of the instant invention is illustrated and it is generally indicated at 50. The improved actuator mechanism 50 comprises a first hydraulic cylinder 17 which is mounted to the inner hull 20 or other fixed submarine structure a hydraulic cylinder link 52 a pivot link 54, a second hydraulic cylinder 56, a rotatable shaft 58, an elongated torque arm 60, a transfer link 62 and a connector link 64. The hydraulic cylinder link 52 is coupled to the first hydraulic cylinder 17 and the first end of the pivot link 54 is pivotably connected to the inner hull by means of a bracket 67. The pivot link pivots around a pivot point 68. The second end of the hydraulic cylinder link 52 is pivotably connected to the second end of the pivot link 54 at pivot point 66. The first end of the second hydraulic cylinder 56 is pivotably connected to the second end of the pivot link 54 at pivot point 66. The rotatable shaft 58 is carried in a bracket 69 which is mounted to the inner hull 20. The first end of the elongated torque arm 60 is keyed to the rotatable shaft 58, and the second end thereof is pivotably connected to the second end of the second hydraulic cylinder 56 at pivot point 72. The first end of the transfer link 62 is also keyed to the rotatable shaft 58. The shaft 58, the torque arm 60, and the transfer arm 62 rotate around a pivot point 70. The second end of the transfer link 62 is pivotably connected to the first end of the connector link 64 at pivot point 74. The second end of the connector link 64 is pivotably connected to the shutter door 10 via a bracket 75 which defines a pivot point 76. The shutter door 10 is pivotably connected to the outer hull 14 at pivot point 78.

Figure 1:
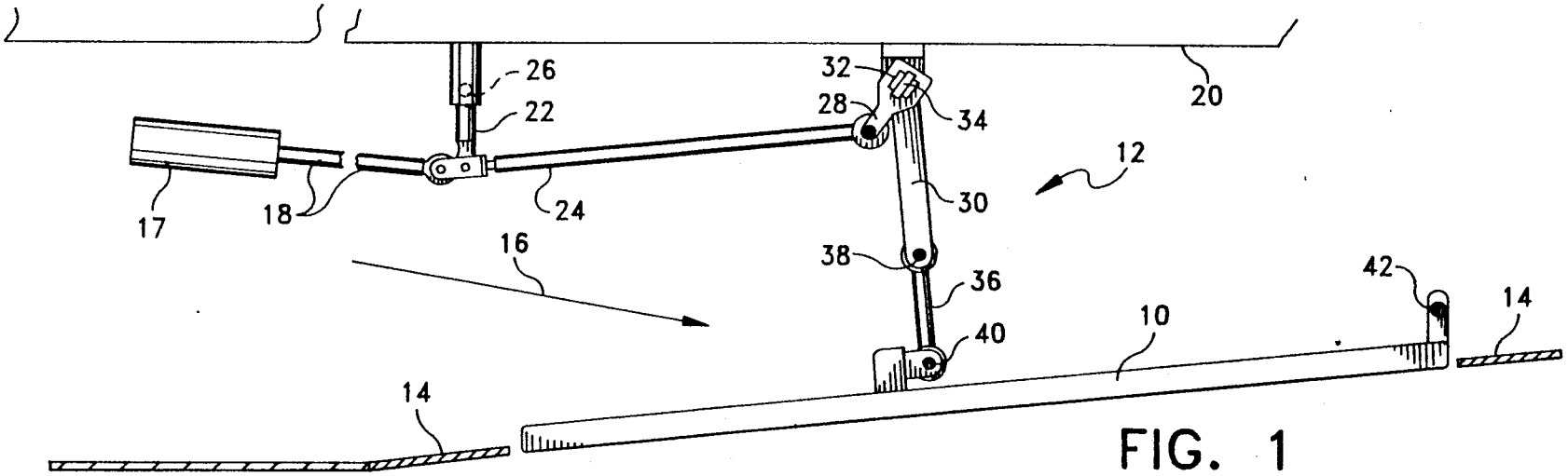
FIG. 1 (PRIOR ART)
FIG. 1 is an elevational view of the prior art actuator mechanism with the shutter door in the closed position.
Figure 2:
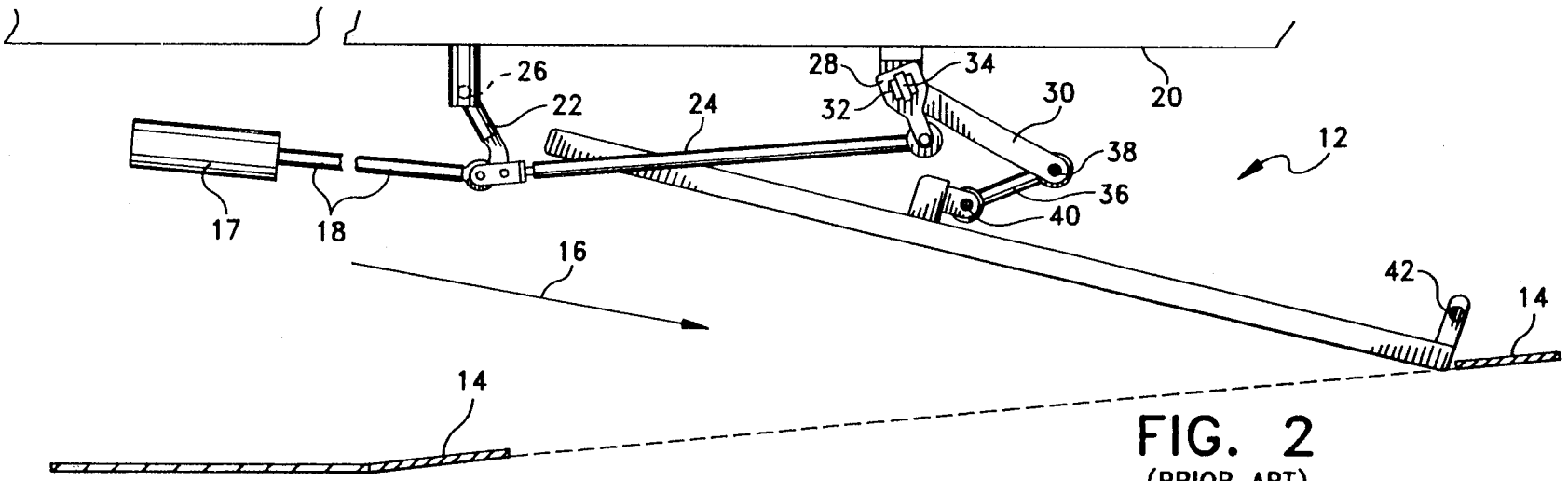
FIG. 2 (PRIOR ART)
FIG. 2 is a similar view thereof with the shutter door in the open position.

The improved actuator mechanism 50 reflects a system similar to the prior art system illustrated in FIGS. 1 and 2 except that link 24 is replaced with a hydraulic cylinder 56 and torque arm 28 is replaced with an elongated torque arm 60. In operation, as the hydraulic cylinder link 52 exerts force to the right it causes the pivot link 54 to rotate in a counterclockwise direction about pivot point 68, thus forcing the second hydraulic cylinder 56 to the right. The second hydraulic cylinder 56 also exerts force to the right as its piston rod 56*a* extends. The movements of the hydraulic cylinder link 52 and hydraulic cylinder 56 to the right combined with extension of their piston rods causes the keyed torque arm 60 and the transfer link 62 to rotate in a counterclockwise direction about the rotatable shaft 58. As the transfer link 62 rotates, it moves the end of the link adjacent pivot point 74 inwardly away from the outer hull 14. As the transfer link 62 further rotates away from the outer hull 14, it draws the connector link 64 and the shutter door 10 inwardly. As can be seen, the improved actuator mechanism 50 operates in a similar manner to the prior art mechanism, except that when it is desired to open the shutter door 10, hydraulic pressure extends the length of the hydraulic cylinder 56 which replaces link 24. Although the extension of the hydraulic cylinder 56 does not transmit any more force through the link than in the prior art assembly, the extra throw of the hydraulic cylinder 56 combined with the normal throw transmitted by the hydraulic cylinder link 52 results in the ability to replace torque arm 28 with the elongated torque arm 60. As is well known in the art, the amount of torque which is transmitted through the pivot point 70 is proportional to the input force multiplied by the length of the torque arm. As a result, the elongated torque arm 60 results in a much higher torque being transmitted to transfer link 62. Since the length of transfer link 62 remains unchanged, a greater force is applied at the end of the link adjacent hinge point 74. This greater force is transmitted through connector link 64 to the shutter door 10. For example, if the torque at hinge point 70 were doubled, then the force tending to open the shutter would also be doubled. Since the angular rotation of all the linkage is unchanged from the prior art assembly, the extra distance that the end of the torque arm 60 adjacent pivot point 72 must travel is accommodated by the extension of the hydraulic cylinder 56.

The only known limitation to the mechanism of the instant invention is that the hydraulic cylinder 56 should not generate more force than is generated through the first hydraulic cylinder, 17 or cylinder 56 would otherwise tend to reverse the direction of the first hydraulic cylinder 17. In addition, stress calculations would have to be performed on the links and pivot points from pivot point 70 to the shutter door 10 to make sure the increased torque does not over-stress any of the parts.

It can therefore be seen that the instant invention provides an improved actuator mechanism for operating a torpedo tube shutter door. The improved actuator mechanism is simple in design and is extremely cost effective. The second hydraulic cylinder and elongated torque arm effectively provide a means for multiplying the force exerted in a shutter operating mechanism without significantly redesigning any major components of the mechanism. In addition, the improved mechanism can be easily back-fitted into a ship employing the prior art shutter operating mechanism. This feature of the invention is extremely important when considering the extreme cost that would be associated with designing a completely new shutter operating system. For these reasons it is believed that the instant invention represents a significant advancement in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a submarine vessel having an inner hull, an outer hull, and a non-pressure bearing shutter door mounted in said outer hull, an actuator mechanism for operating said shutter door comprising:

a first hydraulic cylinder having first and second ends, said first end being mounted to the inner hull;

a pivot link having a first end pivotably connected to said inner hull and a second end pivotably coupled to said second end of said first hydraulic cylinder.

a second hydraulic cylinder having first and second ends, said first end being pivotably connected to said second end of said pivot link;

a shaft rotatably mounted to the inner hull;

a torque arm having first and second ends, said first end being keyed to said rotatable shaft, said second end being pivotably connected to said second end of said second hydraulic cylinder;

a transfer link having first and second ends, said first end being keyed to said rotatable shaft; and a connector link having a first end pivotably connected to said second end of said transfer link and a second end pivotably connected to said shutter door, said shutter door being pivotably connected to said outer hull at one end thereof.

2. In the actuator mechanisms of claim 1, said torque arm being of elongated configuration.

3. In the actuator mechanism of claim 2, the hydraulic pressure in said first cylinder being at least as great as that in said second cylinder.

* * * * *